United States Patent [19]

Beesley et al.

[11] Patent Number: 4,677,909

[45] Date of Patent: Jul. 7, 1987

[54] WASTE TRANSFER PACKERS

[75] Inventors: Brian G. Beesley; Clive Hurley; Ramon H. J. Brend; Thomas P. Edwards; Robert W. D. Sherrell; Andrew J. Vickery, all of Devon, England

[73] Assignee: Devon County Council, Exeter, England

[21] Appl. No.: 731,898

[22] Filed: May 8, 1985

[30] Foreign Application Priority Data

May 10, 1984 [GB] United Kingdom ..... 8411933

[51] Int. Cl.[4] ..... B30B 15/06

[52] U.S. Cl. ..... 100/229; 414/400

[58] Field of Search ..... 100/229 A, 240; 414/303, 332, 398, 400

[56] References Cited

U.S. PATENT DOCUMENTS

| | | | |
|---|---|---|---|
| 3,059,789 | 10/1962 | Bowles | 100/229 A |
| 3,229,618 | 1/1966 | O'Connor, Jr. . | |
| 3,368,478 | 2/1968 | Clar | 100/229 A X |
| 3,747,519 | 7/1973 | Capps, Sr. et al. . | |
| 4,579,053 | 4/1986 | Beesley et al. | 100/229 A |

FOREIGN PATENT DOCUMENTS

| | | |
|---|---|---|
| 649640 | 8/1937 | Fed. Rep. of Germany . |
| 2521109 | 12/1983 | France . |
| 440900 | 1/1936 | United Kingdom . |
| 568855 | 4/1945 | United Kingdom . |
| 700437 | 12/1953 | United Kingdom . |
| 918465 | 2/1963 | United Kingdom . |
| 1095425 | 12/1967 | United Kingdom . |

OTHER PUBLICATIONS

"Pak Mor Midgit Containers Loader System", Hemisfair '68 Pak Mor Co. P.O. Box 14147, San Antonio, Texas.

*Primary Examiner*—Billy J. Wilhite

*Attorney, Agent, or Firm*—Fleit, Jacobson, Coh & Price

[57] ABSTRACT

A waste transfer packer having a horizontally reciprocable ram operating in a hollow spigot to deliver and compress waste material from a chute or hopper, has a spigot adapted to extend into a container through a pair of doors hinged about horizontal axes. Problems can arise on disconnection of the container from the packer due to re-expansion of the load within the container.

The invention provides a spigot extending almost to the position of maximum penetration of the ram so as to continue to support the load while the ram is withdrawn and during disconnection of the container. The spigot shape can provide a sloping or stepped by a suitable profiling of the spigot front face.

10 Claims, 3 Drawing Figures

WASTE TRANSFER PACKERS

It is desirable in the operation of waste transfer packers that the load should be retained, with a minimum of re-expansion, especially on completion of the packing operation. This could be done by leaving the ram that reciprocates into the opening of the transfer container in the position of full penetration on completion of the packing operation. If the ram is not in this position, some spillage willl tend to take place because of the springiness of the material. Leaving the ram in the full penetration position, however, boost pressure having been applied, means that it is difficult or impossible to release the hooks that keep the container coupled to the packer because of the tension on them. Waiting for enough settlement in the load would take an unacceptable time. Thus, even when other precautions are taken against spillage, as in our co-pending application Ser. No. 674,480, now U.S. Pat. No. 4,579,053, there is still the time factor which can involve a wait of upwards of five minutes.

According to one aspect of the invention a waste transfer packer is provided with a reciprocable ram operating in a spigot or register which engages in an opening in the lower part of a wall of a transfer container characterised in that the spigot extends approximately to the full extent of the ram penetration, so as to be capable of retaining the load against re-expansion while the hooks are unlatched. Preferably the full penetration position of the ram is slightly greater than that of the spigot, so that when the ram is withdrawn there is a small relaxation of the load pressure to permit the hooks to be disengaged, but even without this, since the spigot is hollow, it presents small area to the load, so that hook disengagement is made easier, at least in a shorter time than would otherwise be the case.

Preferably the spigot has a lower margin and co-extensive therewith a pair of side walls which extend part way up the ram, the side walls being cut back at an angle above this level to provide the spigot with a sloping load-supporting face.

In another form of the invention the spigot side walls extend vertically from the lower margin about a quarter of the ram height, whereafter they slope backwards to the level of the top of the ram and then extend vertically upwards to the breaker bar of the spigot.

In a further form of the invention the spigot side walls extend vertically from the lower margin about one half of the ram height, whereafter they slope backwards to the level of about three quarters of the ram height and then extend vertically upwards to the breaker bar of the spigot.

The invention further provides a method of operation of a transfer packer and container wherein on completion of the packing operation the ram is returned to a withdrawn position with the spigot retaining the load while the hooks are unlatched.

Figure 1:
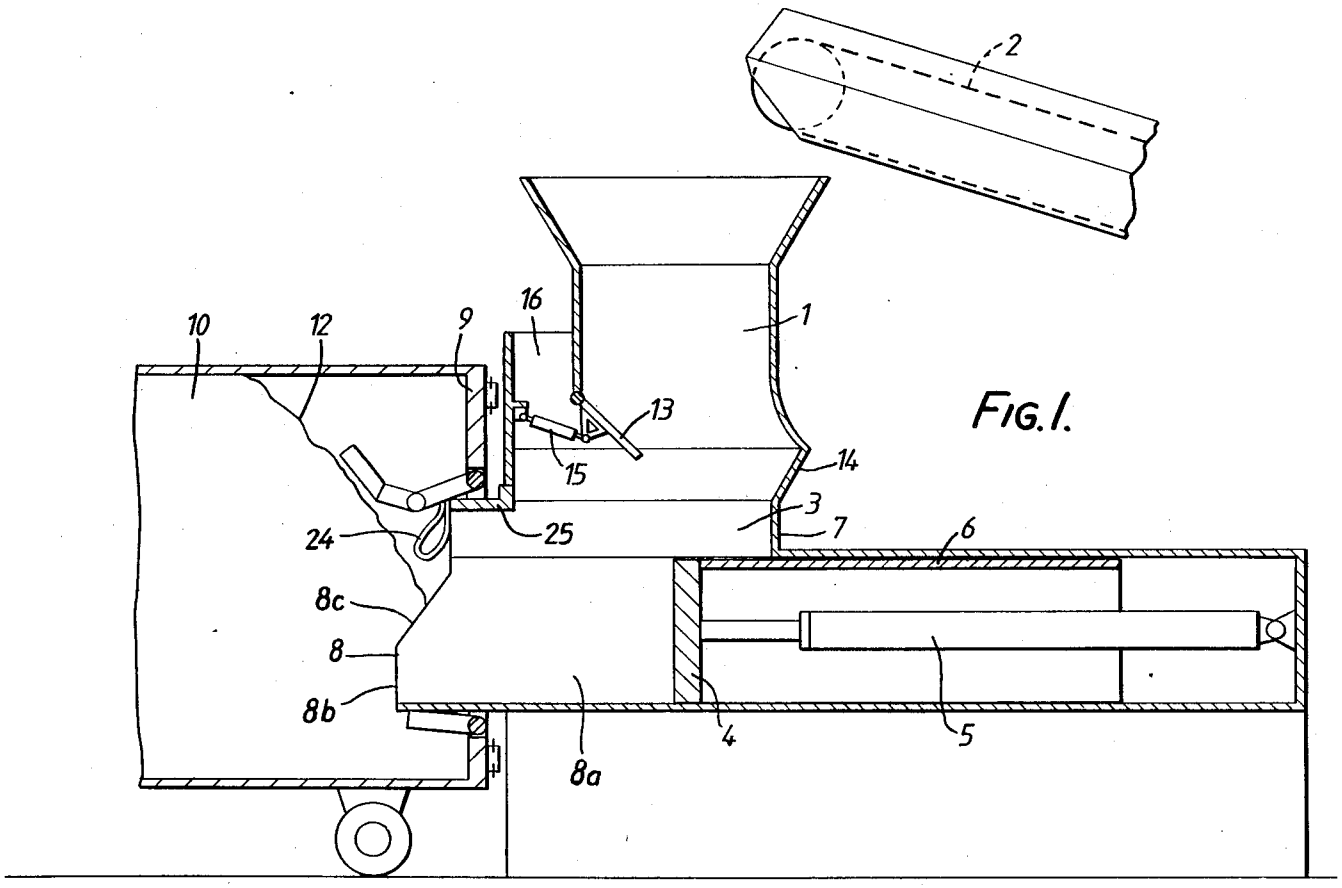
Figure 2:
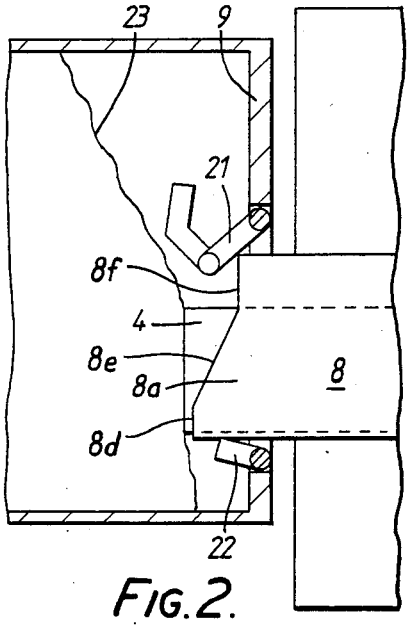
Figure 3:
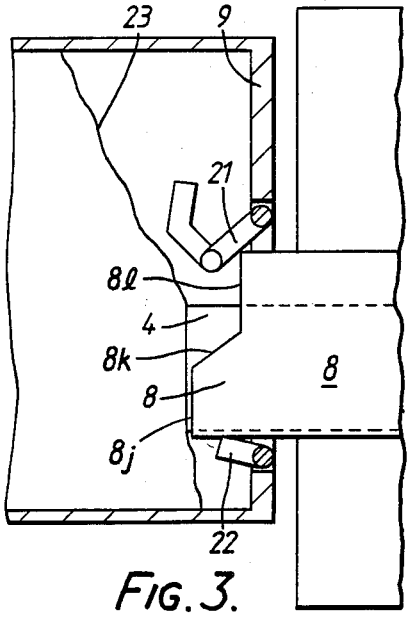

Other features of the invention will appear from the following description having reference to the accompanying drawings in which:

FIG. 1 is a sectional side elevation, schematically represented, of the relevant parts of a packer and a vehicle container, FIG. 2 is a scrap view corresponding to part of FIG. 1 showing one form of spigot, and FIG. 3 is a similar view showing another form of spigot.

Referring to FIG. 1 of the drawings, a feed chute 1 is arranged below the upper delivery point of an elevating conveyor 2 which carries waste from a discharge point (not shown) where collecting vehicles can discharge waste. The chute discharges into a chamber 3 in which a rectangular-faced ram 4 can be reciprocated horizontally by a hydraulic actuator 5. The ram 4 has a rear apron 6 flush with its upper edge. The forward stroke of the ram commences with its forward face in line with the rear wall 7 of the chamber 3. The front of the chamber terminates in a spigot 8 which can extend into a lower loading opening in the rear door 9 of a container 10. The spigot 8 is formed as a somewhat shovel-shaped component having a flat base to which are attached a pair of side walls 8*a*, the further of the two being visible in FIG. 1. The profile of the side walls is characterized by a forward edge extending from the base of the spigot in a vertical portion 8*b*, followed by an upwardly and rearwardly sloping portion 8*c* extending to approximately the level of the top of the ram 4, whereafter they continue vertically towards a horizontal breaker bar 25 of the packer. The loading opening may be closable by doors of the form described in U.S. Pat. No. 4,579,053, which are opened automatically by the entry of the spigot. As the ram moves forward it carries with it waste material that has dropped down in front of it and forces this material into the container 10 along its floor. Continued reciprocation of the ram 4 gradually fills the container, creating as it does so a rear waste wall 12. The bottom of the chute 1 has a deflector 13 supported by a strut 15 and this cooperates with a rearward curve 14 of the chute bottom to cause low density material which may be carried forward on the ram top to circulate and fall in front of the ram on its next stroke. An additional open-topped channel 16 is also provided to accommodate such low density material during the forward stroke and return of the ram.

In FIG. 2 of the drawings the door 9 of the container is shown with a spigot 8 in the engaged position so that the horizontally hinged doors 21 and 22 are opened. The ram 4 is shown projecting from the packer to its maximum extent, that is to say, extending into the container a distance of approximately half the ram height. The spigot 8 is again formed from a flat base to which are attached a pair of side walls 8*a* the profile of which is characterized by a lower short vertical edge 8*d* followed by an upwardly and rearwardly sloping portion 8*e* merging at the level of the top of the ram 4 into a further vertical portion 8*f*. With continued operation of the ram feeding waste into the container a phase is reached where the actuator pressure is balanced by the resistance of the packed material, and it is then given a boost so as to increase the packing density to an optimum value.

In order to prevent the container being pushed away by the ram, the container is secured to the packer by means of hooks which are sometimes hydraulically actuated. However, when the ram is in the forward position as shown in the drawing, and boost pressure is applied, the tension on the hooks can be so great that disengagement cannot be secured by backing the vehicle, which is a usual method. One possibility is to leave the ram in its forward position for long enough to permit the material to become consolidated so that the tension on the hooks is reduced. This, however, can take upwards of five minutes in a typical installation. Withdrawing the ram causes other difficulties such as spillage. The arrangement of the invention, however, makes use of a spigot which has a considerable extension into the interior of the container, and in fact extends virtually all the way (typically within 5 cms.) to the maximum forward position reached by the face of the ram. When disengagement is required therefore, the ram can be withdrawn to a rearward position but the load and the waste wall will be retained in their position with only a small amount of reexpansion taking place. This is on account of the fact that the spigot is slightly back from the position of the ram face in its forward position and also presents a smaller supporting area, this area being constituted of course by the forward edges of the spigot so that a very small amount of re-expansion does take place. This permits the tension on the hooks to be reduced to a degree which permits their disengagement without having to wait for the load to settle, and in the case of the automatic doors of the kind shown at 21 and 22 gives an opportunity for the doors to close when the container is pulled away from the packer.

In addition to retaining the load in position in boost conditions the nose of the spigot also has the effect of retaining the load during each return stroke of the ram. In the case of an ordinary register which does not project appreciably into the container the load in the container will re-expand on each stroke of the packer ram, but with the spigot of the invention the load is retained during such strokes and compaction of the waste material within the container is thereby made more continuous, and an opportunity is given for the load to settle into a final position at an earlier stage than would otherwise be the case. This has the added benefit of reducing the power requirement.

In addition to providing endwise retention of the load, the sloping surfaces 8*e* of the spigot tend to impart to the load an upward component of force which will assist in filling voids or locations of low density within higher density material.

The arrangement shown in FIG. 3 of the drawings is similar to that of FIG. 2 but in this case the lower vertical profile portion 8*j* of the side walls 8 of the spigot 8 is cut off at a lower level (of the order of one third of the way up the ram) and is sloped off at a shallower angle as at 8*k* before rising vertically on a line 8*i* just within the confines of the container. This shape has greater ability to induce vertical forces within the mass of waste in the container and to permit the waste wall to build up further back in the container in cases where this is permissible or desirable.

In both cases the formation of the spigot into a somewhat shovel-like shaped component permits the withdrawal of a certain amount of waste material as the container is moved away from the packer without permitting this material to fall on the floor, and this in turn enables the rear waste wall within the container to move downward as disengagement takes place, to form a more gradual slope of the rear waste wall.

A further expedient to smooth the functioning of the transfer is the provision of a flap, shown as 24 in FIG. 1, in the form of a flexible loop of material such as rubberised fabric, attached to the edge of a top breaker bar 25, and is deflected by the top of the ram 4 or waste material on it, so as to press down on such material. The hingeing of the flap 24 is such that it slower edge can clean off waste material remaining on the upper surface of the ram inside the container as the ram is withdrawn. The contour of the flap, or the contour that it can adopt, is such that it envelopes the underside of the two-part upper door 21, so as further reduce the possibility of this door being fouled by waste material as the container is withdrawn from the packer.

We claim:

1. A waste transfer packer and transfer container combination, said waste transfer packer comprising a feed hopper, a hollow spigot extending substantially horizontally from said feed hopper and adapted to penetrate through an aperture in a wall of the transfer container, and a reciprocable ram operable substantially within said spigot to insert charges of waste material from said free hopper into said transfer container and to compress said charges therein, the maximum penetration of said ram within said transfer container being substantially coextensive with the penetration of said spigot and being of a distance in the order of half the ram height, said spigot having a lower margin and coextensive therewith a pair of side walls, forward edges of said side walls extend upwards initially from a lower margin of said side walls about one quarter of the ram height whereafter said forward edges slope rearwards to about a level of a top of the ram.

2. A waste transfer packer for inserting waste material into a transfer container and compressing it therein, said waste transfer packer comprising a hollow spigot adapted to penetrate through an aperture in a wall of the container, and a reciprocable rectangular ram operable substantially within said spigot to insert charges of waste material in said container and compress said charges of waste material, said spigot including a bottom wall and attached thereto a pair of side walls each with a forward portion adapted to lie within the container and having a profile, viewed from a side, that commences adjacent the bottom wall with a vertical portion having maximum penetration of the container and being cut away therefrom on an upwardly facing slope to a further vertical portion having minimum penetration of the container, said upwardly facing slopes being adapted to provide support for a rearwardly directed wall of waste within the container when the ram is withdrawn.

3. A waste transfer packer according to claim 2 wherein the spigot penetration and the maximum ram penetration are substantially coextensive.

4. A waste transfer packer according to claim 2 wherein the side walls have forward edges which extend upwards initially from the bottom wall about one quarter of the ram height whereafter said forward edges slope rearwards to adjacent the level of the top of the ram.

5. A waste transfer packer according to claim 2 wherein the side walls have forward edges which extend upwards initially from the bottom wall about one half the height of the ram whereafter said forward edges slope rearwards to a level about three quarters of the ram height and then extend upwards towards an upper margin of the spigot.

6. A waste transfer packer according to claim 2 wherein further comprising a feed chute for transferring waste to the spigot, and an upwardly directed channel is provided between the feed chute and a part of the spigot that enters the container so as to provide a buffer for low density material during a forward storke of the ram and from which such material can fall back into the path of the ram on its next stroke.

7. A waste transfer packer for inserting waste material into a transfer container and compressing it therein, said waste transfer packer comprising a rectangular ram reciprocable to penetrate through an aperture in a wall of the container a distance at least half the ram height, and a spigot within which the ram operates and adapted to extend into the container approximately to the full extent of the ram penetration, the spigot having side walls, forward edges of said side walls being sloped back to provide upwardly directed support for compacted material within the container.

8. A waste transfer packer and transfer container combination according to claim 7 further comprising a feed chute for transferring waste to the spigot, and said packer includes an upwardly directed channel between the feed chute and a part of the spigot that enters the container, so as to provide a buffer for low density material during a forward stroke of the ram and from which such material can fall back into the path of the ram on its next stroke.

9. A waste transfer packer and transfer container combination, said waste transfer packer comprising a feed hopper, a hollow spigot extending substantially horizontally from said feed hopper and adapted to penetrate through an aperture in a wall of the transfer container, and a reciprocable ram operable substantially within said spigot to insert charges of waste material from said feed hopper into said transfer container and to compress said charges therein, the maximum penetration of said ram within said transfer container being substantially coextensive with the penetration of said spigot and being of a distance in the order of half the ram height, said spigot having a lower margin and coextensive therewith a pair of side walls, forward edges of said side walls extend upward initially about one half of the ram height whereafter said forward edges slope rearwards to a level about three quarters of the ram height and then extend upwards towards an upper margin of the spigot.

10. A waste tranfer packer and transfer container combination, said waste transfer packer comprising a feed hopper, a hollow spigot extending substantially horizontally from said feed hopper and adapted to penetrate through an aperture in a wall of the transfer container, a reciprocable ram operable substantially within said spigot to insert charges of waste material from said feed hopper into said transfer container and to compress said charges therein, the maximum penetration of said ram within said transfer container being substantially coextensive with the penetration of said spigot and being of a distance in the order of half the ram height, and an upwardly directed channel providing between said hopper and a part of said spigot that enters the container so as to provide a buffer for low density material during a forward stroke of the ram and from which such material can fall back into the path of the ram on its next stroke.

* * * * *